US005879232A

United States Patent [19]

Luter, II et al.

[11] Patent Number: 5,879,232

[45] Date of Patent: Mar. 9, 1999

[54] EXHAUST FAN

[75] Inventors: Robert J. Luter, II; Randall Allen Bickel, both of Elkhart, Ind.

[73] Assignee: Tomkins Industries, Inc., Dayton, Ohio

[21] Appl. No.: 826,346

[22] Filed: Mar. 25, 1997

[51] Int. Cl.[6] ..... F24F 7/013

[52] U.S. Cl. ..... 454/349; 454/354

[58] Field of Search ..... 454/292, 346, 454/347, 349, 353, 354; 362/365, 366, 148, 149, 150; 285/239, 382.5; 248/906

[56] References Cited

U.S. PATENT DOCUMENTS

| | | | |
|---|---|---|---|
| 2,349,668 | 5/1944 | Marker et al. . | |
| 2,800,849 | 7/1957 | Spear . | |
| 3,483,309 | 12/1969 | Kerseg et al. | 174/65 |
| 3,926,537 | 12/1975 | Piper | 417/353 |
| 4,073,597 | 2/1978 | Barnhart et al. | 415/201 |
| 4,336,749 | 6/1982 | Barnhart et al. . | |
| 4,834,615 | 5/1989 | Mauch et al. | 415/213.1 |
| 4,867,640 | 9/1989 | Penlesky et al. | 415/204 |
| 4,886,415 | 12/1989 | Engelberger et al. | 415/119 |
| 4,901,376 | 2/1990 | Ivey | 4/213 |
| 4,913,621 | 4/1990 | Reither | 415/215.1 |

FOREIGN PATENT DOCUMENTS 658728 3/1963 Canada .

*Primary Examiner*—Harold Joyce

[57] ABSTRACT

An exhaust fan for bathrooms and the like having two principal structural elements—a housing assembly and a motor plate assembly—wherein the housing assembly includes a generally cylindrical housing formed of injection molded plastic. The housing assembly includes a circumferential mounting flange and mounting clips carried thereon for mounting the fan in a ceiling panel or the like in an arbitrary angular orientation. Flexible mounting tabs on the motor plate assembly releasably engage notches on the housing for snap together assembly. Integral strain relief for power supply wiring is molded into a wiring compartment in the housing. An oval duct connector having an outer circumferential lip extends from an exhaust outlet and is adapted to releasably engage a round flexibly resilient spring reinforced duct thereover. The motor plate assembly also covers the wiring compartment when fitted into the housing assembly.

23 Claims, 10 Drawing Sheets

26
44
20
34
36
34
50
38
40
32
12
60
46
160
48
24
50
28
30
120
122
134
124
10
14
116
112
42
110
130
140
136
126
140
170
114
170
140
52
52
16

EXHAUST FAN

BACKGROUND OF THE INVENTION

The invention relates to the field of exhaust fans, and more particularly to exhaust vent fans for bathrooms and the like. Specifically, the invention relates to an improved exhaust fan that may be installed in a ceiling panel, or the like, in an arbitrary orientation about an axis perpendicular to the ceiling panel to permit easier mounting therein.

Exhaust vent fans are typically mounted in ceilings or walls by fastening directly to joists or studs. As such, the installed fan may only be oriented in a limited number of ways. Because vent fans typically have exhaust outlets fixed in orientation relative to the fan housing, the manner of connecting exhaust ducting to the outlets is similarly limited. As a result, the placement and orientation of an exhaust vent fan may be restricted or involve additional installation expense.

During installation of an exhaust vent fan, it is necessary to connect electrical wiring to the fan. Both Underwriter's Laboratory, Inc., and the National Electrical Code require that strain relief be provided to prevent the wiring from being pulled out of the fan. Generally, a separate strain relief must be installed on the fan before the wiring can be connected. This may increase the number of parts installed, or involve an additional installation step, thereby increasing the installation expense or delay.

Also during installation, an exhaust duct is usually connected to an exhaust outlet for directing the vented air or gases to a desired location. Round flexible vinyl or aluminum duct including a heliform wire is often used. Typically, the duct is secured to the outlet with a band clamp, tie wrap, tape, or other fastening means. The use of additional fasteners may add to the cost of or time required for installation.

Furthermore, it is desirable to have an exhaust vent fan that may be assembled quickly and easily with as few tools as possible. It is also desirable to be able to disassemble the fan for cleaning, repair, or replacement. While many fans are capable of being assembled and disassembled with relative ease, the use of a tool, such as a screwdriver, is often required.

Also, it is desirable to manufacture an exhaust vent fan with as few parts as possible. By reducing the parts count, the cost of the fan may be reduced, the difficulty and time of installation may be reduced, and the reliability of the fan may be increased. One manner of reducing parts count is by manufacturing previously separate parts as a single integral part. Another manner of reducing parts count is by designing parts to fulfill functions previously performed by more parts.

SUMMARY OF THE INVENTION

The invention is an improved exhaust vent fan for bathrooms and the like. The fan has two major structural elements—a housing assembly and a snap-in motor plate assembly. The essentially two-piece construction of the fan combined with the snap-in assembly simplifies mounting and assembly of the fan.

The housing assembly preferably includes a generally cylindrical housing formed of injection molded plastic having a side wall, a top wall, opposite the top wall an air inlet defined by the side wall, and an outer peripheral mounting flange. A scroll within the housing cooperates with the side wall and the top wall to define a generally volute blower cavity and a generally crescent-shaped wiring compartment, with the scroll positioned between the two. Molding the housing from plastic reduces the number of separate parts, simplifies manufacture, and eases mounting and assembly of the fan.

Carried on the mounting flange is a plurality of mounting clips operable from the underside of the fan and proportioned to engage a ceiling panel or the like. The round housing and the mounting clips are adapted to permit the fan to be installed in a generally cylindrical opening in a ceiling panel or the like in an arbitrary angular orientation with the flange abutting the underside of the panel. Exhaust ducting can thereby be brought to the fan in the most convenient manner.

Extending from an exhaust outlet in communication with the blower cavity is an oval-shaped exhaust duct connector portion with a circumferential lip extending therefrom for engaging an inner surface of a spring-reinforced flexible exhaust duct. Installing the duct only requires flattening the end of the duct to generally conform to the shape of the oval duct connector, sliding the duct over the connector and past the lip, and releasing the duct. The positive action of the spring attempting to restore the duct to its original shape causes the duct to grip the sides of the connector thereby securing the duct to the connector without the use of any clamps or other fasteners.

Molded into the housing in the wiring compartment is an integral strain relief. No additional components are needed to secure power supply wiring within the housing assembly. And, the wiring compartment is automatically sealed shut by the action of the motor plate assembly snapping into place in the housing assembly.

Extending from the periphery of the motor plate assembly is a plurality of elongate flexible mounting tabs having protuberances extending from an outer face thereof. The protuberances snap into corresponding notches in the housing when the motor plate assembly is pressed into place. Flexing the tabs inwardly permits removal of the motor plate assembly without the need for tools.

Therefore, it is an object of the invention to provide an exhaust fan having a generally cylindrical housing and novel fasteners or mounting clips that permit the fan to be installed in a ceiling or wall panel in an arbitrary angular orientation about an axis perpendicular to the panel.

It is a further object of the invention to provide an exhaust fan housing having an integral strain relief formed therein.

Yet another object of the invention is to provide an exhaust fan having an oval exhaust outlet duct connector including an outer circumferential lip that releasably engages an inner surface of a flexibly resilient round duct.

Still another object of the invention is to provide an exhaust fan having a motor plate assembly including flexibly resilient mounting tabs having protuberances that releasably engage notches in a fan housing to permit mounting and removal of the motor plate assembly without using any tools.

Another object of the invention is to provide an exhaust fan having a motor plate assembly that covers a wiring compartment when assembled in place in the fan.

Yet another object of the invention is to provide an exhaust fan having an injection molded plastic fan housing and a motor plate assembly, thereby reducing the number of principal structural elements to two.

Other objects and advantages of the invention will be apparent from the following description, the accompanying drawings and the appended claims.

DETAILED DESCRIPTION OF THE PREFERRED EMBODIMENT

Figure 1:
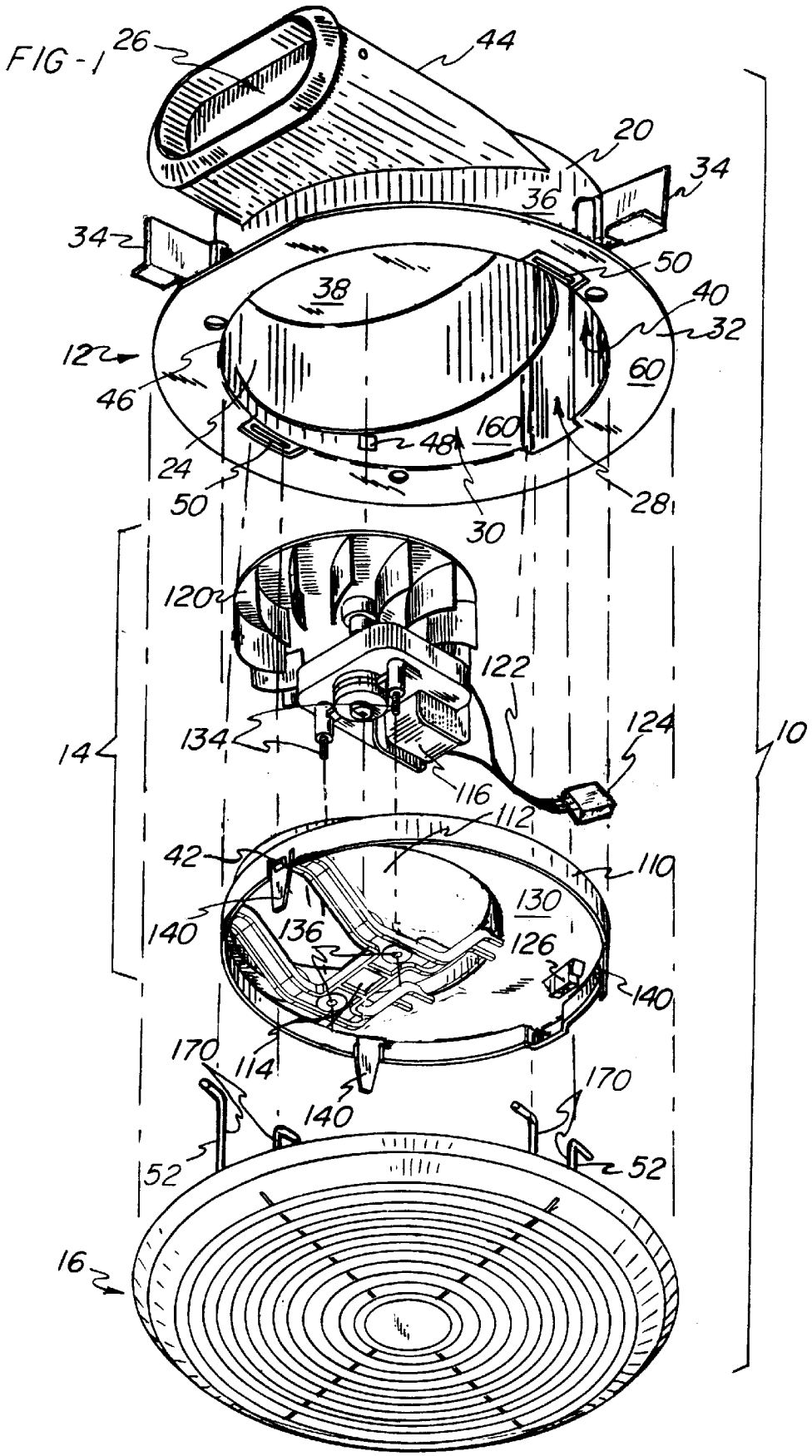
FIG. 1 is an exploded perspective view of an exhaust fan of the invention.
Figure 2:
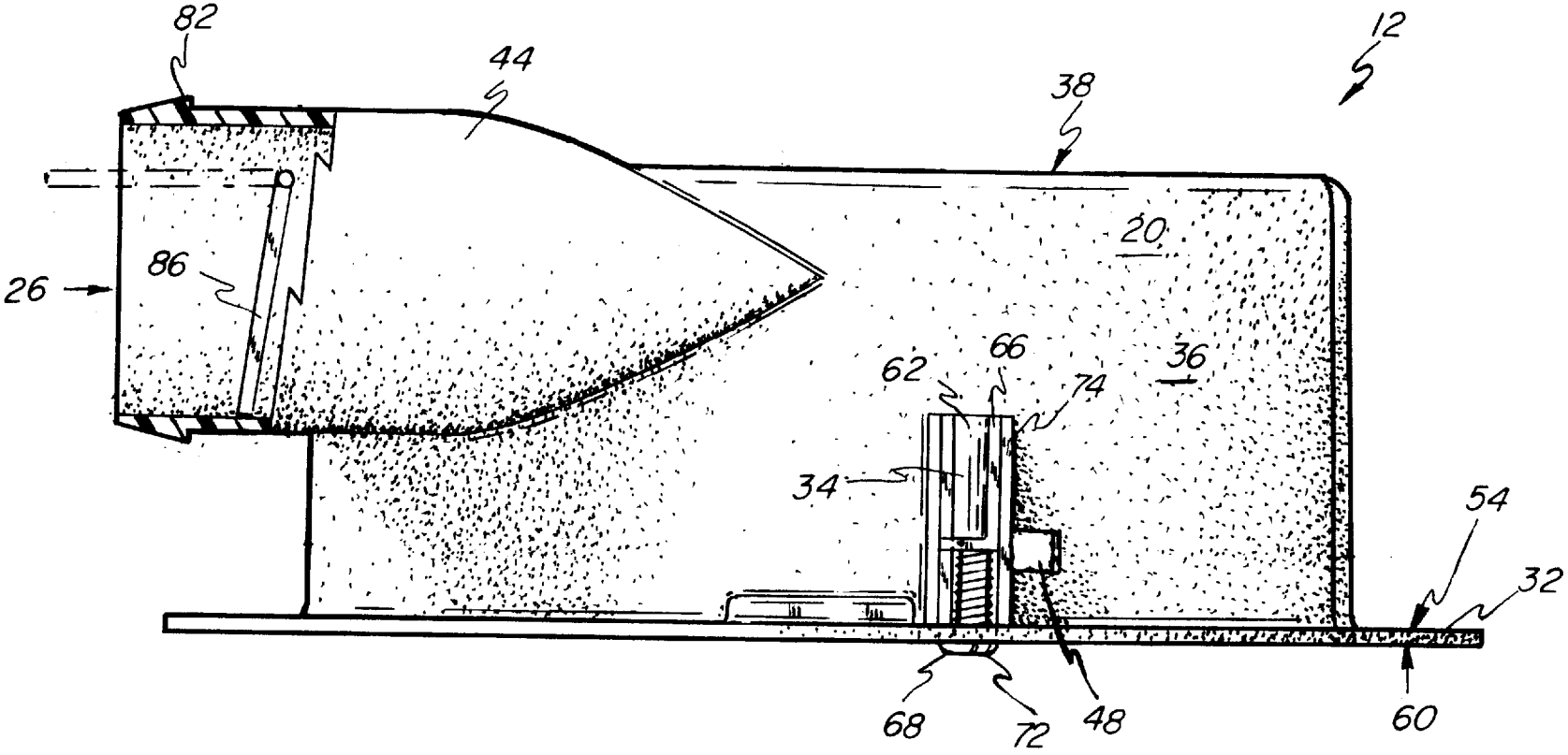
FIG. 2 is a side elevation view of a fan housing assembly.
Figure 3:
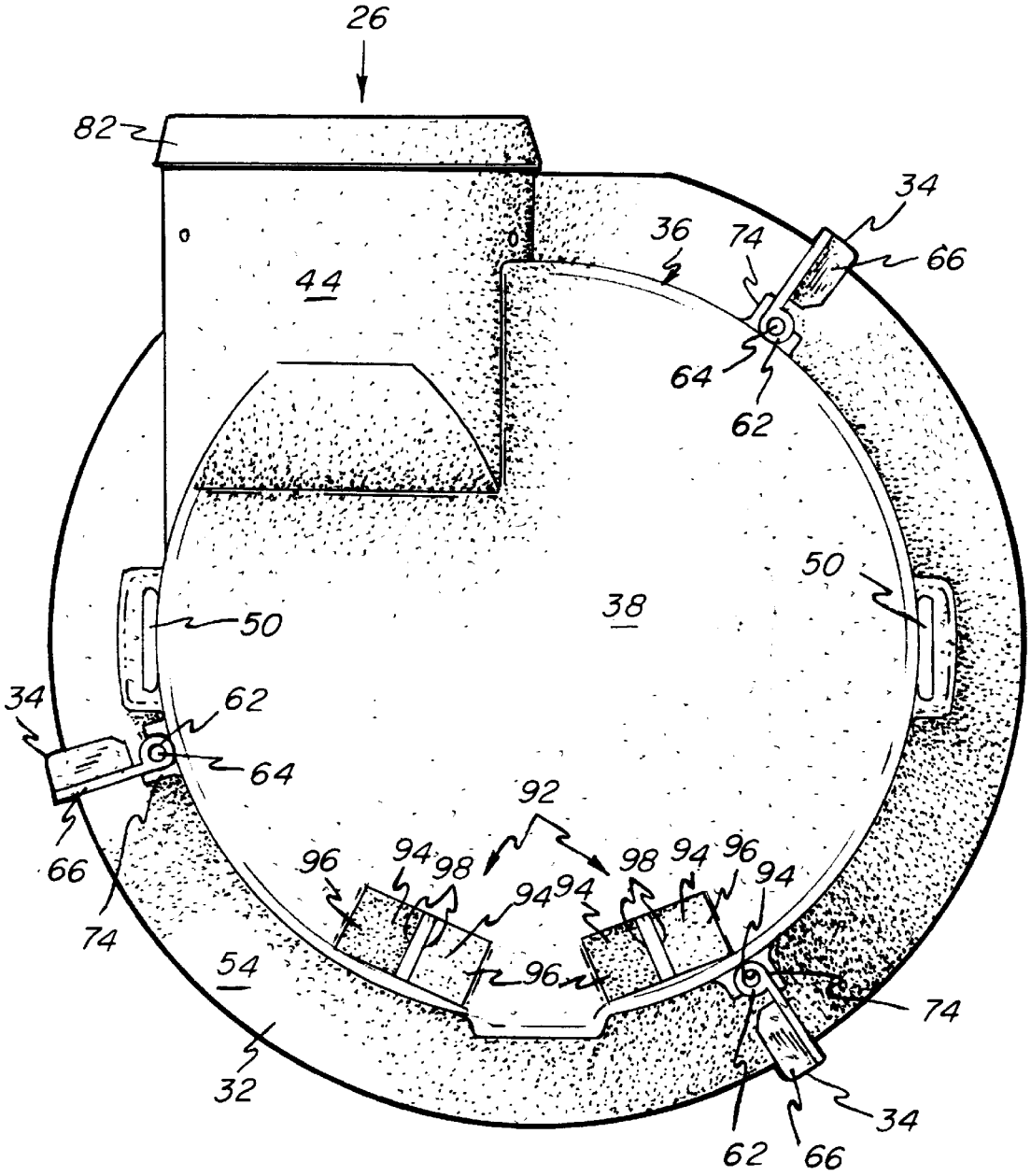
FIG. 3 is a top plan view of a fan housing assembly.
Figure 4:
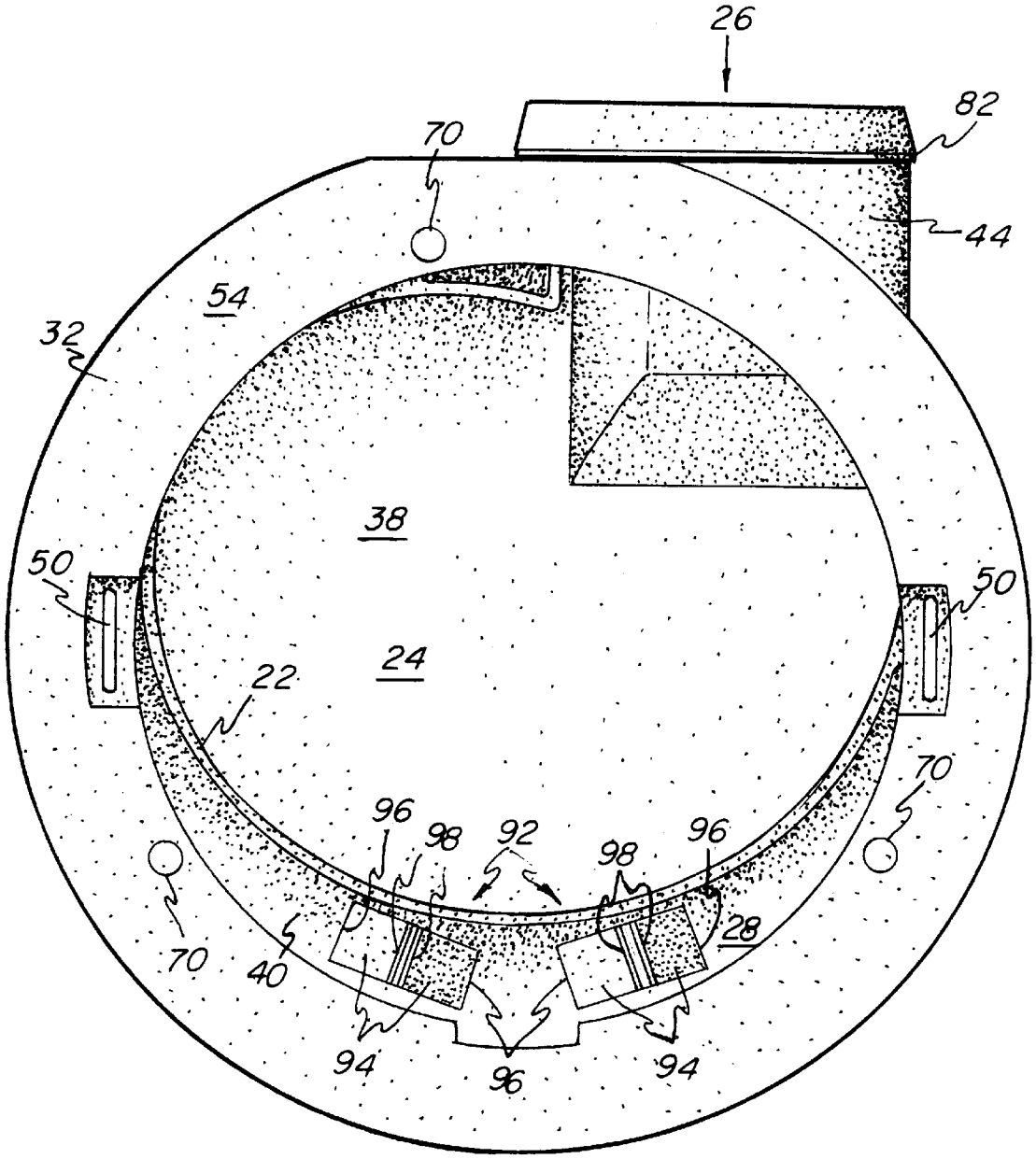
FIG. 4 is bottom plan view of a fan housing assembly.

Referring to FIG. 1, the exhaust fan 10 of the present invention includes a housing assembly 12, a motor plate assembly 14, and a decorative grille 16. In FIGS. 2–4, it may be seen that the housing assembly 12 includes a body portion or housing 20, a scroll 22, a blower compartment or cavity 24, an exhaust port or outlet 26, a wiring compartment 28, an air inlet 30, a peripheral mounting flange 32, and a plurality of fasteners or mounting clips 34.

Preferably, the housing or body portion 20 is generally cylindrical about a longitudinal axis with a side wall 36 and a top wall 38, and formed of injection molded ABS plastic. The scroll 22 cooperates with the side wall 36 and top wall 38 to define the generally volute blower compartment or cavity 24 and a crescent-shaped wiring compartment 28. The wiring compartment 28 has a wiring access opening 40 accessible through the air inlet 30 to permit access to power supply wiring 42 (FIG. 9) therein. The exhaust outlet 26 has an exhaust duct connector portion 44 extending generally radially away from the housing 20 and communicating with the blower compartment 24 to permit air drawn in through the air inlet 30 to be exhausted from the blower compartment 24. The air inlet 30 has a peripheral edge 46 lying in a plane with the circumferential mounting flange 32 extending radially outwardly therefrom. Notches 48 are arranged about the periphery of the housing 20 adjacent the mounting flange 32 for mounting the motor plate assembly 14 in the housing assembly 12. Spring clip retaining slots 50 are molded into the housing 20 in spaced relation for attaching the decorative grille 16 by means of spring clips 52 on the grille 16.

Figure 5:
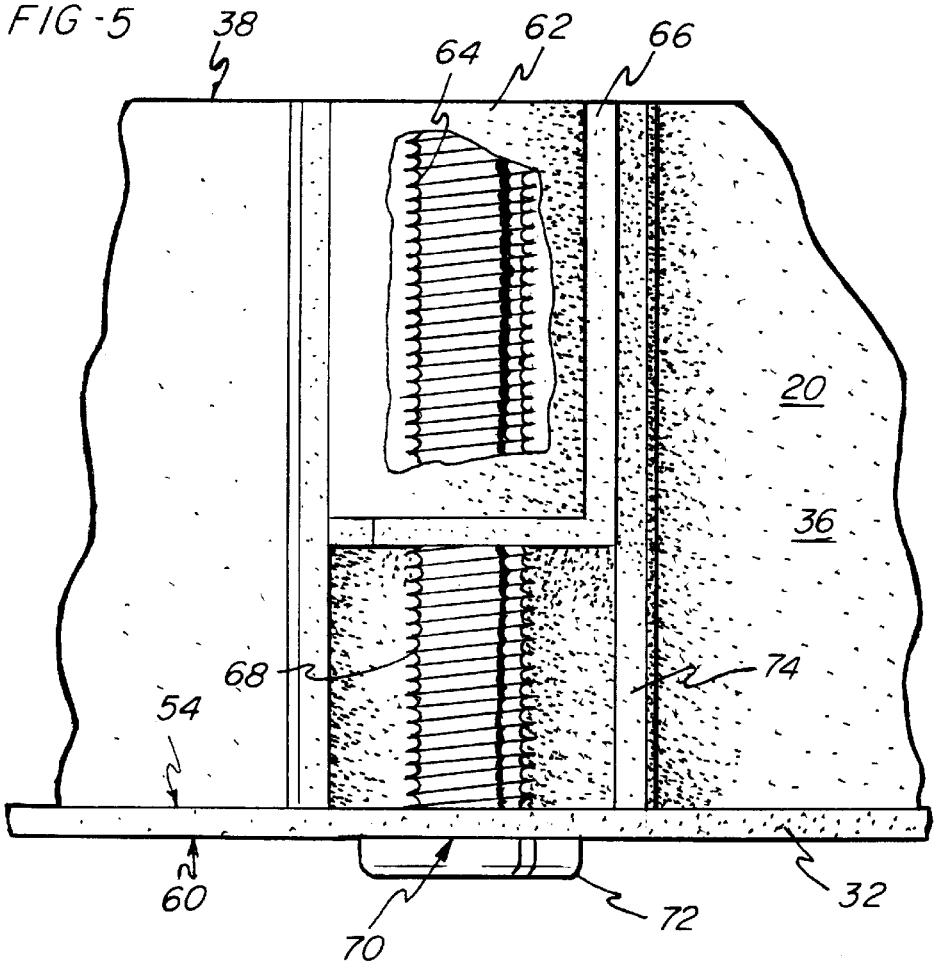
FIG. 5 is a detailed elevation partially broken-away view of a mounting clip on a housing assembly.
Figure 6:
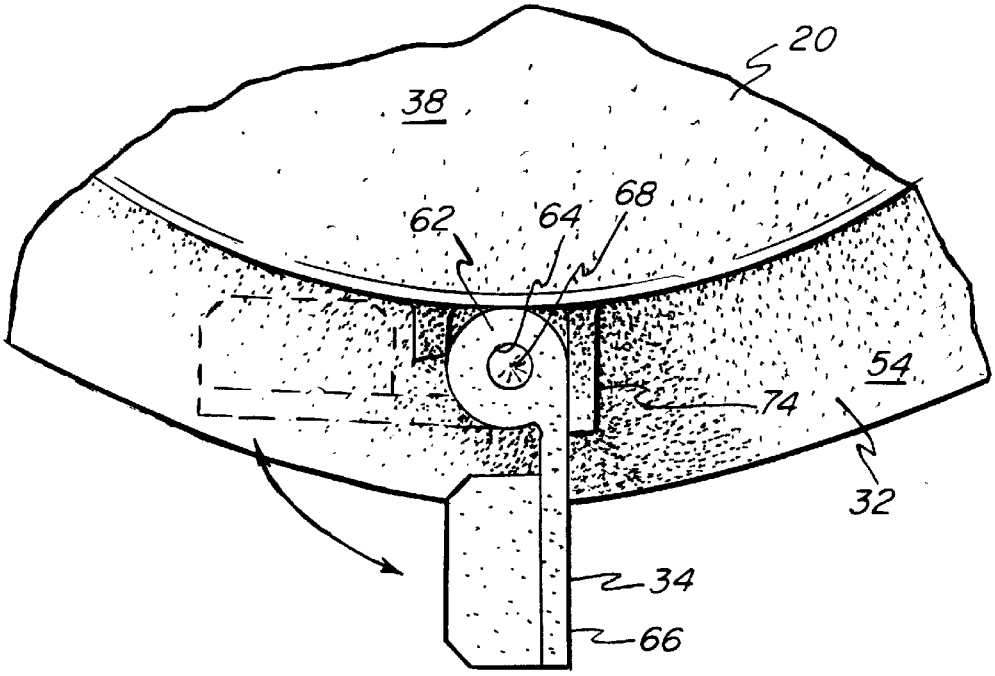
FIG. 6 is an enlarged top plan view of a mounting clip on a housing assembly.

The mounting flange 32 of the housing 30 has an upper side 54 proportioned to abut against a lower surface 56 of a ceiling panel 58 (FIG. 14) or the like and a lower side 60 that faces away from the ceiling panel 58 when the housing assembly 12 is mounted in a circular opening 61 (FIG. 14) in the panel 58. A plurality of fasteners or mounting clips 34 are carried on the mounting flange 32 for securing the housing assembly 12 to the ceiling panel 58. As may be seen more clearly in FIGS. 5 and 6, each mounting clip or fastener 34 has a generally cylindrical or barrel-shaped threaded portion 62 with a threaded bore 64 therein, and a retainer portion 66 extending generally radially from the threaded portion 62. The threaded portion 62 and retainer portion 66 extend above the upper side 54 of the mounting flange 32. A screw 68 extends from below the mounting flange 32 through a hole 70 in the flange 32 and threadably engages the threaded portion 62 such that a driving head 72 of the screw 68 is accessible from below the mounting flange 32. Stop means 74 on the housing 20 defines an extended position of the mounting clip 34 such that the retainer portion 66 extends generally radially away from the housing 20. As shown in FIG. 6, the mounting clip 34 is movable between the extended position and a retracted position wherein the mounting clip 34 is folded back to a position adjacent the housing 20. When inserted in the opening 61 in the ceiling panel 58, the threaded portion 62 and retainer portion 66 of the mounting clip 34 are positioned above the ceiling panel 58.

Figure 7:
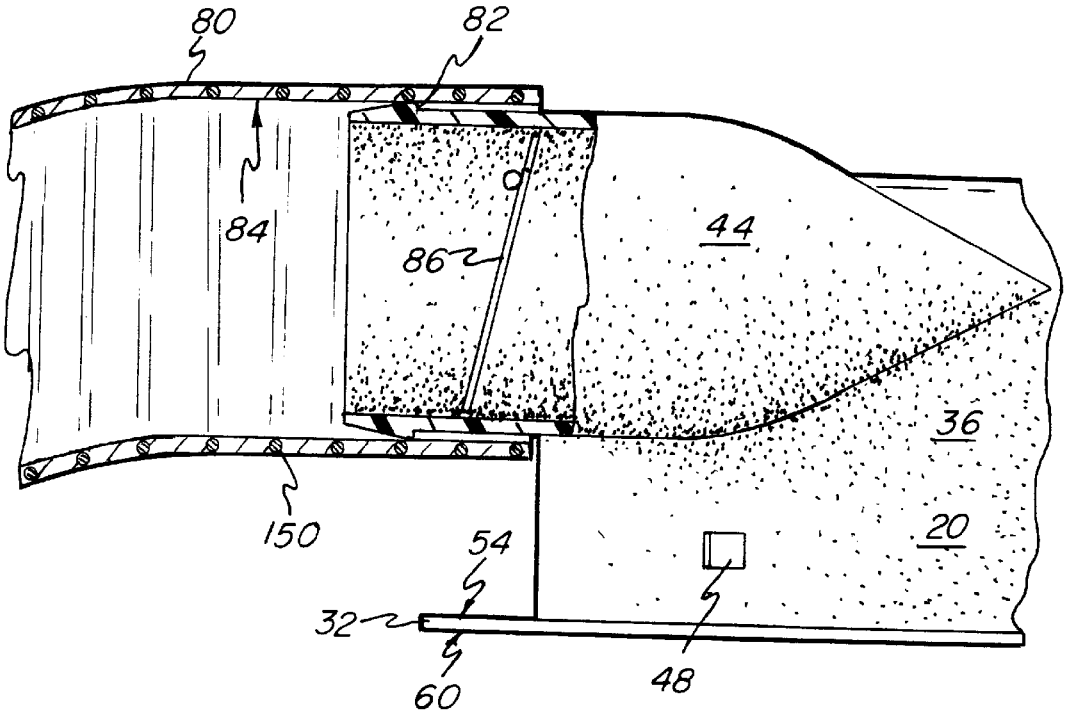
FIG. 7 is a detailed side elevation view of an oval exhaust duct connector showing a connection with a spring reinforced exhaust duct.
Figure 8:
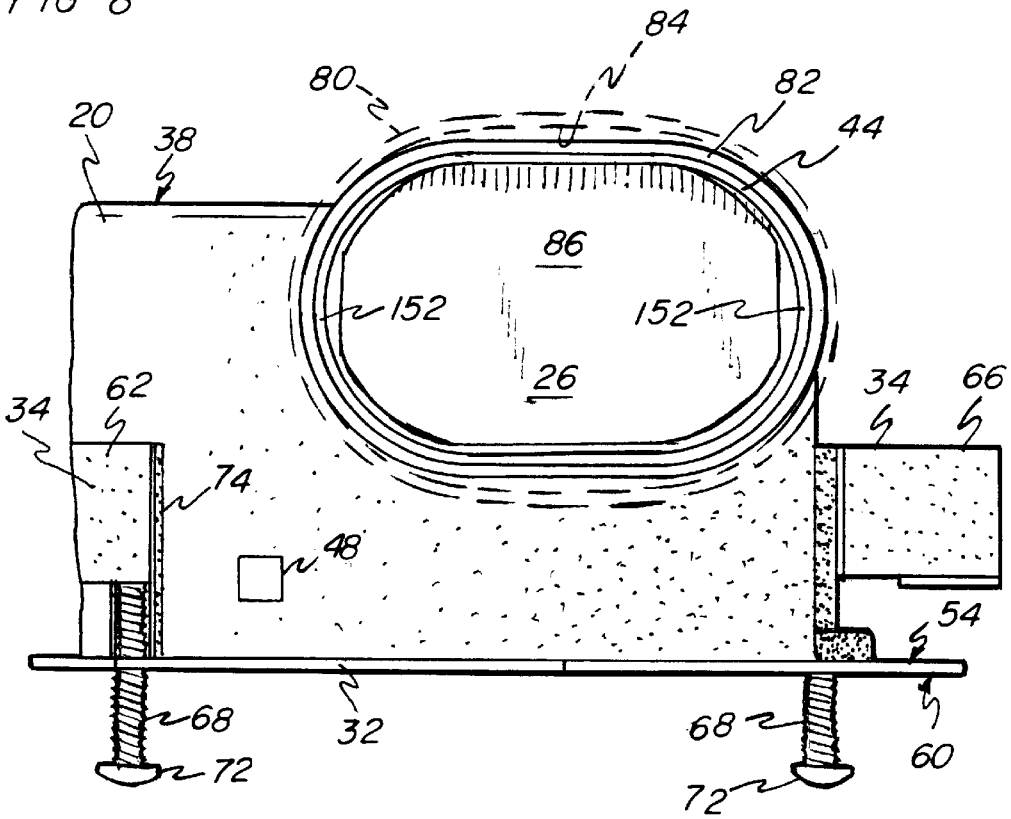
FIG. 8 is a detailed front elevation view of an oval exhaust duct connector showing a connection with a spring reinforced exhaust duct.

Turning now to FIGS. 7 and 8, it may be seen that the exhaust duct connector portion 44 extending from the exhaust port or outlet 26 is preferably oval in cross section and adapted to receive thereover a spring reinforced flexible exhaust hose or duct 80. A circumferential lip 82 extends radially outwardly from the duct connector 44 and is proportioned to engage an inner surface 84 of the hose or duct 80 and resist movement of the duct 80 off of the duct connector 44. The exhaust duct connector 44 further includes a lightweight flap or louver 86 hingedly connected therein and adapted for rotation between an open position and a closed position for substantially sealing the exhaust outlet 26 to prevent back filtration of air into the fan 10 when the fan 10 is not operating while presenting relatively little resistance to exhaust air when the fan 10 is operating.

Figure 9:
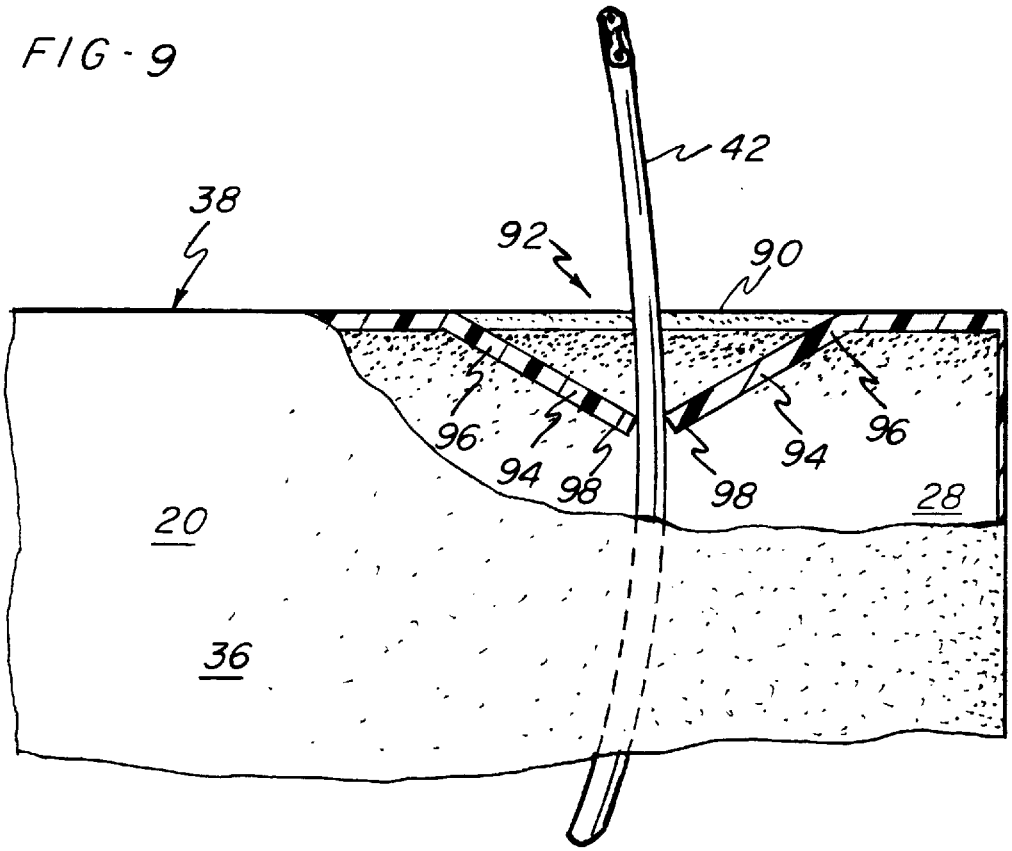
FIG. 9 is an enlarged side elevation view partially in cross section of an integral strain relief showing a power supply wire disposed therein.

Referring to FIG. 9, the housing 20 further includes a wiring entrance 90 in the top wall 38 to permit power supply wiring 42 to be inserted through the housing 20 into the wiring compartment 28. The wiring entrance 90 preferably is a generally rectangular slot formed integrally in the top wall 38 of the housing 20, but could be formed in the side wall 36, the top wall 38, or both according to user requirements, so long as the power supply wiring 42 can be inserted into the wiring compartment 28. Formed unitarily with the housing 20 is at least one integral strain relief 92 for preventing tensile strain imparted to a portion of the power supply wiring 42 disposed exteriorly to the housing assembly 12 from being transmitted to a portion of the wiring disposed interiorly to the wiring compartment 28. Preferably, the integral strain relief 92 includes at least one tang 94 having a pivot end 96 pivotally connected to the body portion 20, and a gripping end 98 extending substantially within the wiring entrance slot 90 and biased inwardly toward the interior of the wiring compartment 28. The gripping end 98 is adapted to engage wiring in snug frictional fit. In a preferred embodiment, the integral strain relief 92 includes a pair of tangs 94 having pivot ends 96 connected to the housing 20 at opposite sides of the wiring entrance 90. The gripping ends 98 are disposed in adjacent spaced relation to each other to grip wiring therebetween.

Figure 10:
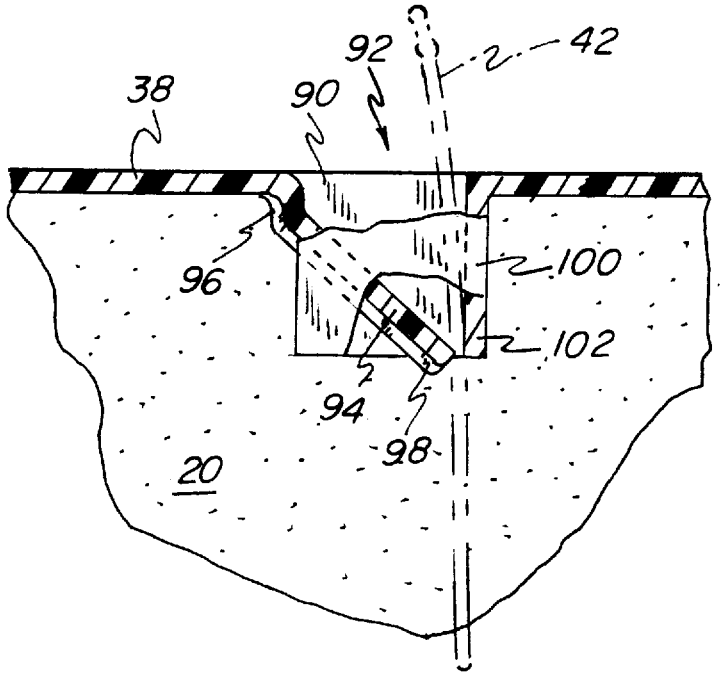
FIG. 10 is a side elevation view partially in cross section of an alternative embodiment of the integral strain relief.

In an alternative preferred embodiment, shown in FIG. 10, the integral strain relief 92 includes a tang 94 having a pivot end 96 connected to the housing 20 and a gripping end 98 disposed substantially within the wiring entrance slot 90 and biased inwardly. A fixed wall portion 100 terminating in a free end 102 spaced a predetermined distance from the gripping end 98 extends from the housing 20 adjacent the end of the wiring entrance slot 90 opposite the pivot end 96 and interiorly to the wiring compartment 28.

Figure 11:
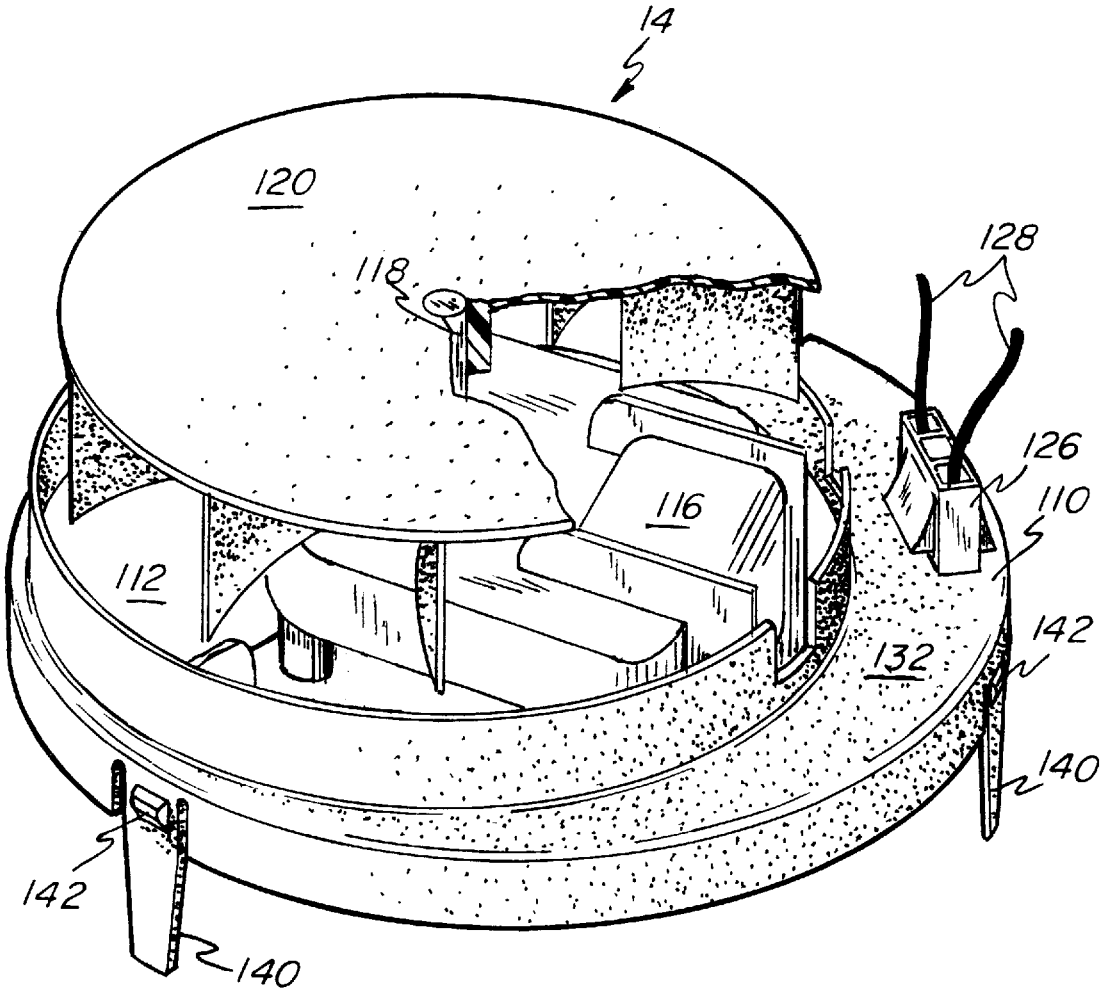
FIG. 11 is a top perspective and partially broken-away view of a motor plate assembly of the invention.
Figure 12:
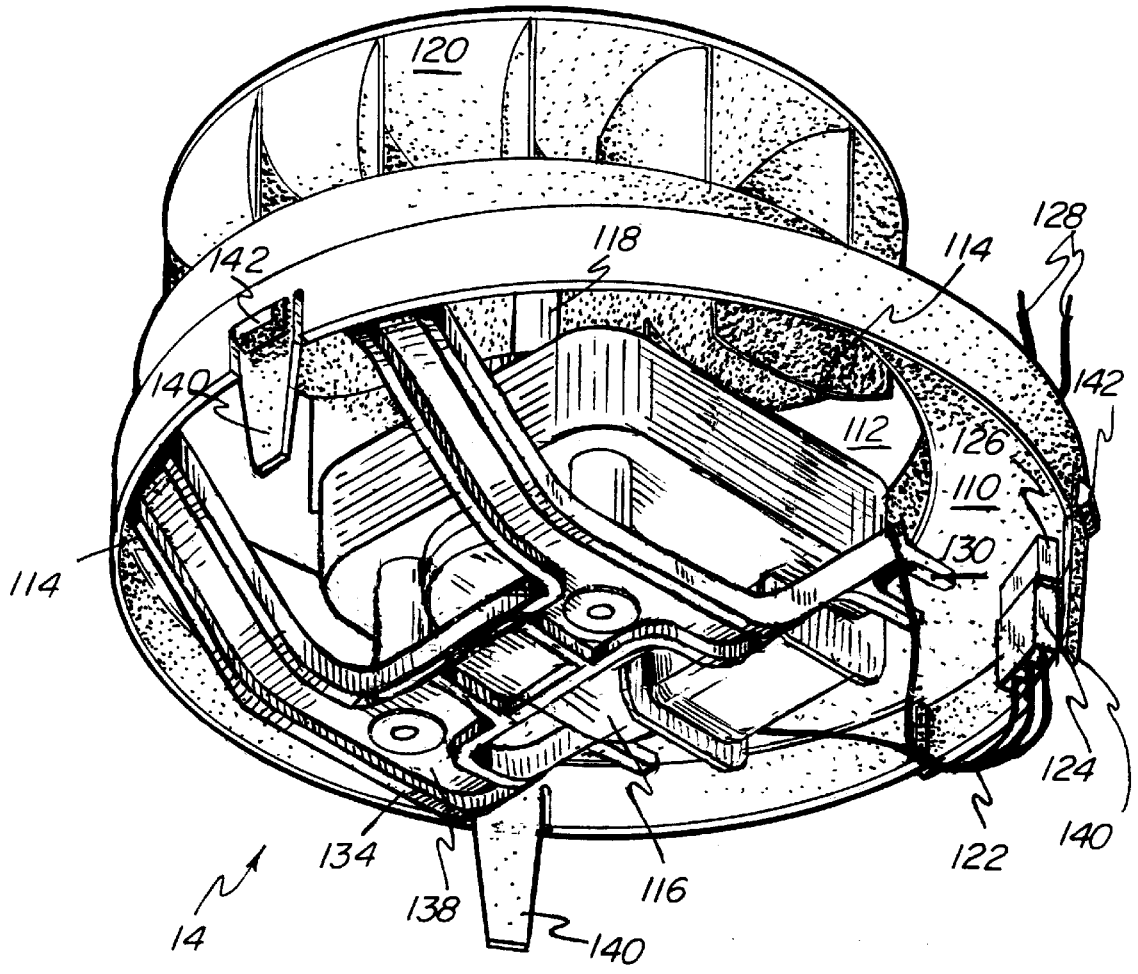
FIG. 12 is a bottom perspective view of a motor plate assembly.

The motor plate assembly 14, shown in FIGS. 11 and 12, includes a plate 110 defining a venturi opening 112 therein, a motor mount support strut 114, a motor 116 having a rotatable shaft 118, a fan blade 120 mounted on the shaft 118, motor power wires 122 extending from the motor 116 and terminating in a plug 124, and a jack 126 mounted on the plate 110 having motor plate power wires 128 extending therefrom. When the motor plate assembly 14 is fitted into the housing assembly 12, the venturi opening 112 is in substantial registration with the blower compartment 24. The fan blade 120 is preferably an impeller wheel. The jack 126 preferably extends through the plate 110 such that the plug 124 plugs into the jack 126 on the lower side 130 of the plate 110 with the motor plate power wires 128 extending from the jack 126 on the upper side 132 of the plate 110.

The plate 110 and motor mount 114 are preferably formed unitarily from injection molded ABS plastic with the motor mount 114 having a plurality of legs or struts. Alternatively, without limitation, the plate 110 and motor mount 114 could be formed or machined from polypropylene, polycarbonate, aluminum, or any other suitable material. Preferably, the motor mount 114 forms a generally H-shaped or four-legged yoke spanning the venturi opening 112, although other embodiments may be used, such as, for example, a generally Y-shaped or three-legged yoke structure. Motor mount screws 134 extend through motor mount holes 136 in the strut 114 and motor mount nuts 138 are threadably received thereon to secure the motor 116 to the strut 114. While the foregoing motor mount structure is preferred, the motor 116 could be mounted to the plate 110 by alternative means. For example, by way of illustration without limitation, the motor 116 could be mounted by riveting or welding.

Figure 13:
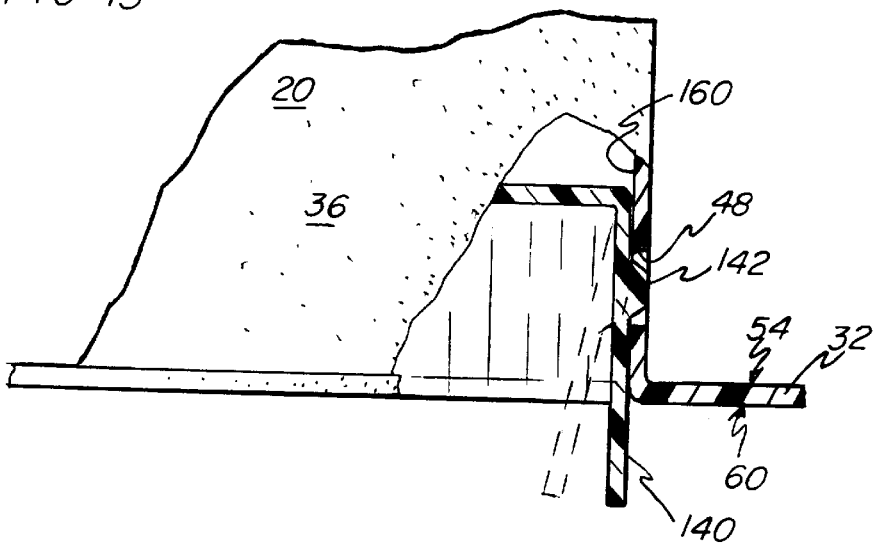
FIG. 13 is a detailed side elevation view in cross section of a flexible mounting tab of the motor plate assembly engaging a notch of the fan housing.

As may be seen in FIGS. 12 and 13, flexible mounting tabs 140 having protuberances 142 are arranged about the periphery of the plate 110 in spaced relation and are proportioned for releasable engagement with the notches 48 of the housing 20. The tabs 140 extend downwardly from the plate 110 with the protuberances 142 on an outer face thereof.

The decorative grille 16 (FIG. 1) is preferably circular and has a diameter greater than the outer diameter of the mounting flange 32 for covering the flange 32 from view. However, the grille 16 may be any suitable shape sufficient to cover the mounted fan 10. Although the grille 16 is pervious to airflow therethrough, it prevents objects and foreign matter from entering the air inlet 30 while presenting an aesthetically pleasing appearance to a viewer. Spring clips 52 are spaced about the grille 16 for engagement with the spring clip retaining slots 50 of the housing 20 and retain the grille 16 in flush position against the lower surface 56 (FIG. 14) of the ceiling panel 58. Preferably, the grille 16 is formed from injection molded ABS plastic, but may be made of any suitable material or by any suitable method known in the art.

Figure 14:
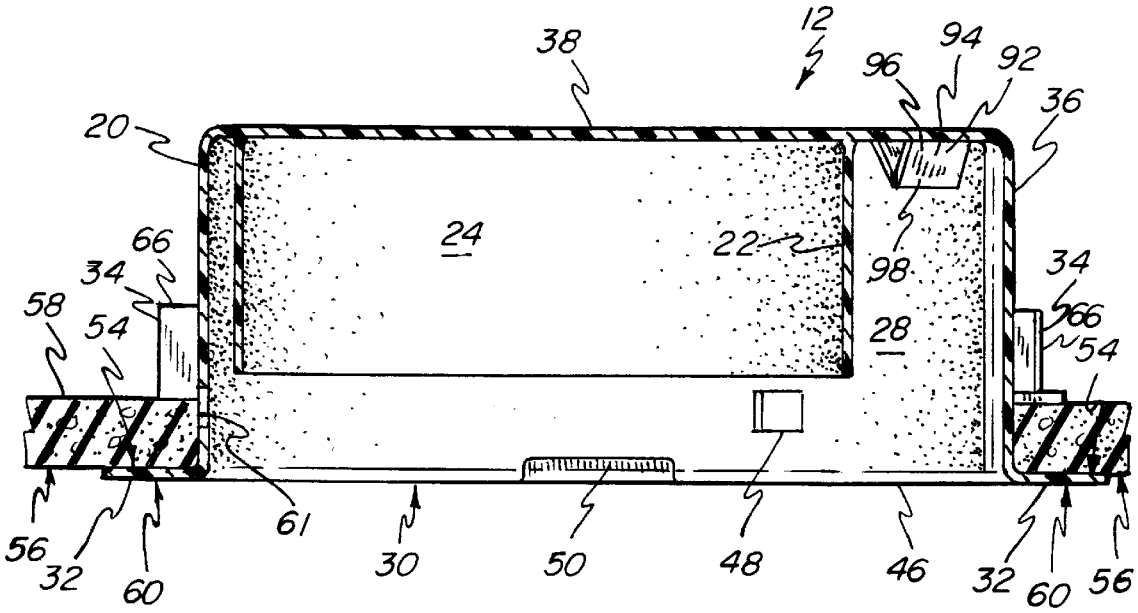
FIG. 14 is a side elevation view in cross section of a fan housing assembly of the invention mounted in a ceiling panel.

When mounting the fan 10 in a ceiling panel 58, as in FIG. 14, an opening 61 corresponding in size and shape to the proportions of the housing 20, preferably circular, is cut in the panel 58. Power supply wiring 42 disposed above the panel 58 is snaked through the panel opening 61 and inserted through the wiring entrance 90 into the wiring compartment 28 with a minimum of insertion force where it is engaged in snug frictional fit by the gripping end 98 of the integral strain relief 92. The integral strain relief 92 tends to resist movement of the power supply wiring 42 back out of the housing 20 due to tensile strain on a portion of the wiring disposed exteriorly to the housing 20, thereby preventing the strain from being imparted to a portion of the wiring disposed interiorly to the housing 20.

Circular flexibly resilient duct 80 having a shape-maintaining helical wire or reinforcing spring 150 therein disposed above the panel 58 is similarly snaked through the panel opening 61 and slid over the duct connector portion 44. The end of the round duct 80 is flattened into a substantially oval shape corresponding in size and shape to the proportions of the duct connector 44, then slid over the circumferential lip 82 and on to the duct connector 44. When the end of the duct 80 is released, the helical wire or reinforcing spring 150 causes the duct 80 to attempt to resume its normally round shape, thereby causing the duct 80 to grip the sides 152 of the duct connector 44 along the long transverse axis of the oval duct connector 44. The circumferential lip 82 further engages the inner surface 84 of the duct 80 to resist movement of the duct 80 off of the duct connector 44.

Next, the mounting clips 34 are folded back into a retracted position adjacent the housing side wall 36. The housing assembly 12 is then fully inserted into the panel opening 61 until the upper surface 54 of the mounting flange 32 contacts the lower surface 56 of the panel 58, and rotated to the desired angular orientation. The mounting clips 34 extend upwardly from the mounting flange 32 through the panel opening 61. A screwdriver, or the like, is applied to the driving head 72 of a screw 68, accessible from the lower side 60 of the mounting flange 32, and the screw 68 is pushed upwardly until the mounting clip 34 is positioned above the ceiling panel 58. A torque is applied to the screw 68 causing the mounting clip 34 to rotate from the retracted position until further rotation of the mounting clip 34 is arrested by the stop means 74 in the extended position, whereupon the mounting clip 34 extends generally radially away from the housing 20. Thereafter, further rotation of the screw 68 causes the mounting clip 34 to be drawn linearly downward along the length of the screw 68 toward the ceiling panel 58 until the ceiling panel 58 is securely held between the mounting clip 34 and the mounting flange 32. The foregoing operations are repeated until all of the mounting clips 34 are in secure abutment against the upper surface of the ceiling panel 58 with the upper surface 54 of the mounting flange 32 in abutment with the lower surface 56 of the ceiling panel 58.

Next, ends of the power supply wiring 42 in the wiring compartment 28 are joined with the appropriate ends of the motor plate power wires 128 to establish electrical power communication between an electrical power supply (not shown) and the fan motor 116. The motor plate assembly 14 is then oriented with the impeller wheel 120 extending into the blower cavity 24 and the flexible tabs 140 having protuberances 142 are aligned with the corresponding notches 48 on the housing 20 above. As the motor plate assembly 14 is pressed upwardly into the housing assembly 12, the force of the inner surface 160 of the housing side wall 36 against the protuberances 142 causes the flexible tabs 140 to flex inwardly, allowing the protuberances 142 to slide over the inner surface 160 of the side wall 36 until all of the protuberances 142 have snapped into the corresponding notches 48. When fitted into the housing assembly 12, the motor plate 110 covers the wiring access opening 40 to protect the wiring therein.

To complete mounting the exhaust fan 10, the decorative grille 16 is positioned below the housing 20 with the legs 170 of the spring clips 52 oriented toward the housing 20 and aligned with the corresponding spring clip slots 50. The legs 170 of the spring clips 52 are then squeezed together, the ends of the legs 170 inserted into the respective spring clip slots 50, and the spring clips 52 released to permit the legs 170 to spread apart. As the grille 16 is pressed toward the ceiling panel 58, the legs 170 of the spring clips 52 spread apart against the sides of the spring clip slots 50, thus causing the grille 16 to be drawn toward the ceiling panel 58 in secure abutment against the ceiling panel 58. Optionally, the decorative grille 16 may be omitted, if desired, or alternatively, a grille could be fastened directly to the ceiling panel 58.

To disassemble the exhaust fan 10, a positive pulling force is applied to the grille 16. As the grille 16 pulls away from the ceiling panel 58, the sides of the spring clip slots 50 cause the legs 170 of the spring clips 52 to squeeze together. After the grille 16 has been drawn sufficiently far away from the ceiling panel 58, the spring clip 170 are then manually squeezed together and withdrawn from the spring clip slots 50, thereby exposing the housing assembly 12 and motor plate assembly 14.

To remove the motor plate assembly 14, an inwardly directed force is applied to each flexible tab 140 to cause their respective protuberances 142 to withdraw from their respective notches 48. A pulling force is applied to the motor plate assembly 14 to withdraw the motor plate assembly 14 from the housing assembly 12. If further disassembly is required, the previous assembly steps may be performed in reverse order to achieve the required degree of disassembly.

It can be seen from the foregoing description that the exhaust fan 10 includes two principal structural elements—the housing assembly 12 and the motor plate assembly 14—with the housing assembly 12 including the housing 20 formed of injection molded plastic having the generally cylindrical side wall 36, the top wall 38, the air inlet 30 opposite the top wall 38, the scroll 22 disposed therein cooperating with the side wall 36 and the top wall 38 to define the blower compartment 24 and the wiring compartment 28 with the scroll 22 therebetween, the integral strain relief 92 formed in the top wall 38 in the wiring compartment 28, the outer circumferential mounting flange 32 adjacent the air inlet 30, the exhaust outlet 26 communicating with the blower compartment 24, and the exhaust outlet duct connector 44 with the circumferential lip 82 extending generally radially outwardly from the exhaust outlet 26. The essentially two-piece structure of the fan 10 provides for easy assembly and disassembly of the fan in the field. In addition, the molded construction of the housing 20 simplifies the manufacture of the fan 10, reduces the parts count, and provides for a durable, relatively lightweight fan having excellent moisture resistance and electrical insulating properties.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An exhaust fan for mounting in a circular opening in a panel and providing for unlimited angular positioning of an exhaust port with respect to the ceiling panel, comprising a fan housing having a generally cylindrical body portion adapted to be received within said circular opening, said body portion having the exhaust port extending generally outwardly therefrom and positioned above said panel when said body portion is inserted within said panel opening, said body portion further provided with a generally radially extending circumferential flange proportioned to abut a lower surface of said ceiling panel when said body portion is fully inserted in said circular opening, said housing being rotatable in relation to said panel to position said exhaust port for ease of access to an air exhaust duct above said panel, a plurality of fasteners carried on said flange accessible from a position below said panel, each said fastener having a threaded portion above said flange terminating in a generally radially extending retainer portion, each said fastener being moveable between a retracted position in which said retainer portion is turned to a position adjacent said body portion and an extended position in which said retainer portion extends generally radially from said housing, stop means on said housing defining said retracted and extended positions, each said threaded portion receiving an operator screw extending through a hole in said flange with the driving head of said screw positioned below said flange for access from a position below said panel, said fastener being rotatable by said screw from said retracted position to said extended position by said stop means and thereafter moveable linearly along said screw to draw said retainer portion against said panel for securing said housing in a selected position with respect to said panel, and wherein said exhaust port is oval in cross-section over a substantial portion of its length, and is proportioned to receive a spring reinforced flexible exhaust hose thereover by the flattening of said hose into an oval shape against its reinforcing spring whereby the resiliency of said hose when released tends to cause said hose to return to a circular shape on said exhaust port causing the sides of said hose to grip said exhaust port along its long transverse axis.

2. The exhaust fan of claim 1 in which said exhaust port is formed with an outer circumferential lip proportioned to engage said exhaust hose and resist movement of said exhaust hose off of said port.

3. An exhaust fan for mounting in an opening in a panel comprising:

a housing assembly including a blower compartment, an exhaust outlet in communication with said blower compartment, an air inlet in communication with said blower compartment having a peripheral edge lying in a plane, a scroll, and a wiring compartment, said wiring compartment separated from said blower compartment by said scroll, said wiring compartment having a wiring access opening, and a motor plate assembly proportioned to fit within said air inlet and adapted to cover said wiring access opening when said motor plate assembly is fitted within said air inlet.

4. The exhaust fan recited in claim 3 wherein said housing assembly further includes a plurality of notches adjacent said peripheral edge, and said motor plate assembly further includes a plurality of flexible mounting tabs having protuberances, said mounting tabs arranged about the periphery of said motor plate assembly and proportioned to releasably engage said protuberances with said plurality of notches, whereby said motor plate assembly is adapted for mounting in said housing assembly by aligning said protuberances with said notches and pressing said motor plate assembly into said housing assembly until said protuberances snap into said notches, and said motor plate assembly is adapted for removal from said housing assembly by flexing said tabs to disengage said protuberances from said notches and withdrawing said motor plate assembly from said housing assembly.

5. An exhaust fan for installation in an opening in a panel and providing for coupling a round flexible duct having therein a helical wire to said fan comprising:

a housing assembly having a body portion, said body portion having an exhaust outlet extending generally outwardly therefrom and positioned above said panel when said body portion is inserted within said panel opening, said exhaust outlet including a duct connection having a substantially oval cross section and proportioned to receive thereover said round flexible duct by flattening said duct into a substantially oval shape, whereby when said duct is released said helical wire tends to cause said duct to return to a round shape on said duct connection causing said duct to grip said duct connection.

6. The exhaust fan recited in claim 5 wherein said duct connection includes a circumferential lip extending outwardly therefrom proportioned to engage an inner surface of said duct.

7. An exhaust fan for mounting in an opening in a panel comprising:

a housing assembly having a body portion including, an electrical wiring compartment having at least one wiring entrance, and at least one integral wiring strain relief formed unitarily with said body portion, whereby said wiring strain relief prevents tensile strain imparted to a portion of power supply wiring disposed exteriorly to said housing assembly from being transmitted to a portion of said wiring disposed interiorly to said wiring compartment, and wherein said at least one integral wiring strain relief comprises at least one tang proportioned to fit within said wiring entrance including, a pivot end pivotally connected to said body portion, and a gripping end extending substantially within said entrance, said gripping end biased inwardly toward the interior of the wiring compartment, whereby said at least one tang is pivotable inwardly to permit insertion of said wiring into said wiring compartment with a minimum of insertion force, and said gripping end is adapted to engage said wiring in snug frictional fit.

8. The exhaust fan recited in claim 7 wherein said integral strain relief comprises a pair of tangs having pivot ends pivotally connected to said body portion at opposite sides of said wiring entrance opening and gripping ends disposed in adjacent spaced relation to each other to grip said wiring therebetween.

9. The exhaust fan recited in claim 7 wherein said housing assembly further includes a scroll and a wiring compartment, said scroll separating said wiring compartment from said blower compartment, and said motor plate assembly is proportioned to cover said wiring compartment when said motor plate assembly is fitted within said housing assembly.

10. The exhaust fan recited in claim 7 wherein said body portion further includes a plurality of notches, and said motor plate assembly further includes a plurality of flexible mounting tabs having protuberances arranged about the periphery of said motor plate assembly proportioned to releasably engage said plurality of notches.

11. The exhaust fan recited in claim 7 wherein said body portion includes an exhaust outlet extending generally outwardly therefrom having a substantially oval duct connector for attaching a substantially circular flexibly resilient exhaust duct at an exterior portion of said connector, said duct connector including a circumferential lip extending outwardly from said oval duct connector and proportioned to engage said duct at an inner surface of said duct and resist movement of said duct off of said connector.

12. An exhaust fan for mounting in a panel comprising:

a housing assembly including a substantially cylindrical side wall, a top wall, an exhaust outlet extending generally radially outwardly from said housing assembly, a scroll cooperating with said side wall and said top wall to define a substantially volute blower compartment, said blower compartment in communication with said exhaust outlet, a mounting flange extending radially outwardly from said side wall having an upper surface proportioned to abut a lower surface of said panel when said fan is fully inserted in said opening, a plurality of mounting clips carried on said mounting flange for securing said housing assembly to said panel; and a motor plate assembly including a plate proportioned to fit within said housing assembly, said plate spaced a predetermined distance from said top wall, a substantially circular venturi opening in said plate having a diameter smaller than a diameter of said blower compartment and having substantial registration with said blower compartment, a motor mount strut spanning said venturi opening;

whereby said housing assembly is rotatable in said panel opening to a predetermined orientation with respect to said panel.

13. The exhaust fan of claim 12 wherein said housing assembly further includes at least one electrical wiring strain relief formed integrally with said housing assembly for preventing strain imparted to a portion of electrical power supply wiring entering said housing assembly disposed exteriorly to said housing assembly from being transmitted to a portion of said wiring disposed interiorly to said housing assembly.

14. The exhaust fan recited in claim 13 wherein said at least one electrical wiring strain relief comprises:

a slot formed in either said top wall, or said side wall, or both, and at least one tang proportioned to fit within said slot, including a pivot end pivotally connected to said housing assembly, and a gripping end extending substantially within said slot, said tang biased inwardly of said housing assembly;

whereby said at least one tang is pivotable inwardly to permit insertion of said power supply wiring into said interior with a minimum of insertion force, and said gripping end is proportioned to engage said wiring in snug frictional fit.

15. The exhaust fan recited in claim 12 wherein each of said plurality of mounting clips comprise:

a substantially cylindrical threaded portion extending upwardly from said upper side, said threaded portion including a threaded bore along its longitudinal axis, and a retainer portion extending substantially radially outwardly from said threaded portion and being positioned above said panel when said housing assembly is inserted in said panel opening, a screw extending through a hole in said mounting flange to threadably engage said bore, and stop means extending from said housing assembly adjacent said threaded portion, whereby during mounting in said panel said mounting clip is first pivoted to lie substantially flat against said housing assembly, said housing assembly is positioned in said panel opening until said mounting flange contacts said panel, a torque is applied to said screw to pivot said mounting clip until said stop arrests said mounting clip, and further torque is applied to said screw to draw said mounting clip toward said mounting flange until said panel is held securely between said retainer portion and said mounting flange.

16. The exhaust fan recited in claim 12 wherein said scroll cooperating with said side wall and said top wall further defines a wiring compartment, said scroll separating said wiring compartment from said blower compartment, and said motor plate assembly is proportioned to cover said wiring compartment when said motor plate assembly is fitted within said housing assembly.

17. The exhaust fan recited in claim 12 wherein said housing assembly further includes a plurality of notches in said side wall adjacent said mounting flange, and said motor plate assembly further includes a plurality of flexible mounting tabs having protuberances arranged about the periphery of said motor plate assembly proportioned to releasably engage said plurality of notches.

18. The exhaust fan of claim 12 wherein said exhaust outlet further comprises a substantially oval duct connector for attaching a substantially circular flexibly resilient exhaust duct over an exterior portion of said connector, said duct connector including a circumferential lip extending outwardly from said oval duct connector proportioned to engage said duct at an inner surface of said duct and resist movement of said duct off of said duct connector.

19. An exhaust fan for mounting in an opening in a panel and providing for easy assembly of two principal structural elements comprising:

a housing assembly including a housing adapted to be received within said panel opening and formed by molding plastic further including, a side wall, a top wall, a scroll cooperating with said side wall and said top wall to define a generally volute blower compartment separated from a wiring compartment by said scroll, an exhaust outlet communicating with said blower compartment having a duct connector portion extending generally outwardly from said housing and proportioned to be above said ceiling panel when said housing is inserted in said opening, a peripheral mounting flange extending generally outwardly from said housing proportioned to abut a lower surface of said panel when said housing is fully inserted in said panel opening, a plurality of notches arranged about a periphery of said housing; and a motor plate assembly including a motor plate proportioned to fit within said housing and cover said wiring compartment when fully inserted in said housing, said plate defining a venturi opening positioned to communicate with said blower compartment, and said plate including flexible mounting tabs having protuberances proportioned to releasably engage said notches;

whereby said fan is adapted to be assembled by inserting said motor plate assembly into said housing assembly until said protuberances snap into said notches.

20. An exhaust fan for mounting in an opening in a panel comprising:

a molded housing assembly including a blower compartment, an exhaust outlet in communication with said blower compartment, and an air inlet in communication with said blower compartment having a peripheral edge lying in a plane, a molded motor plate assembly proportioned to fit within said air inlet and including a plate defining a plane, a venturi opening through said plate, and a motor mount formed integrally with said plate and arching away from said plane defined by said plate for supporting a motor and fan blade at said venturi opening.

21. The exhaust fan of claim 20 wherein said motor mount is formed as a bridge-like yoke structure including legs attached to said plate and extending upwardly to a common motor support location centrally of said venturi opening.

22. The exhaust fan of claim 20 wherein said motor mount comprises a round snap-in plastic structure.

23. The exhaust fan of claim 20 wherein said motor plate assembly comprises a snap-in structure including tabs having surface portions for engaging cooperating surface portions on said housing assembly, and said tabs are adapted to flex to disengage said surface portions from cooperating engagement for removal of said motor plate assembly from said housing assembly, and said housing assembly further including a peripheral mounting flange extending radially outwardly from said peripheral edge for mating against said panel when said exhaust fan is installed, said tabs including free ends which extend beyond said peripheral mounting flange to facilitate grasping of said tabs during removal of said motor plate assembly.

* * * * *